US005926920A

United States Patent [19]

Denison

[11] Patent Number: 5,926,920

[45] Date of Patent: Jul. 27, 1999

[54] SNAP-IN ADAPTER SYSTEM FOR JEWELRY, NAME TAGS AND THE LIKE

[76] Inventor: Bonnie Denison, 7672 Tamarack La., Ontario, N.Y. 14519

[21] Appl. No.: 09/150,611

[22] Filed: Sep. 10, 1998

[51] Int. Cl.[6] ..... A44C 3/00

[52] U.S. Cl. ..... 24/13; 24/3.1; 24/3.12; 40/1.5

[58] Field of Search ..... 24/3.1, 3.12, 13; 40/1.5

[56] References Cited

U.S. PATENT DOCUMENTS

| | | | |
|---|---|---|---|
| 3,344,543 | 10/1967 | Griffin et al. | 40/1.5 |
| 3,439,439 | 4/1969 | Stimson | 40/1.5 |
| 4,597,206 | 7/1986 | Benson | 24/13 |
| 5,023,978 | 6/1991 | Thompson et al. | 24/3.12 |
| 5,457,852 | 10/1995 | Liu | 24/13 |
| 5,655,271 | 8/1997 | Trumble et al. | 24/3.1 |

FOREIGN PATENT DOCUMENTS

| | | | |
|---|---|---|---|
| 2145552 | 3/1985 | United Kingdom | 24/13 |

*Primary Examiner*—Victor N. Sakran

[57] ABSTRACT

A snap-in adapter system including an interior piece having a circular interior face and a short cylindrical side wall forming a cylindrical recess, the recess having an interior diameter. The system also includes an exterior piece. The exterior piece has a circular exterior face with a diameter essentially equal to that of the diameter of the recess of the interior piece. The exterior piece also has a cylindrical projection. Also provided is an attachment means.

14 Claims, 3 Drawing Sheets

FIG 5
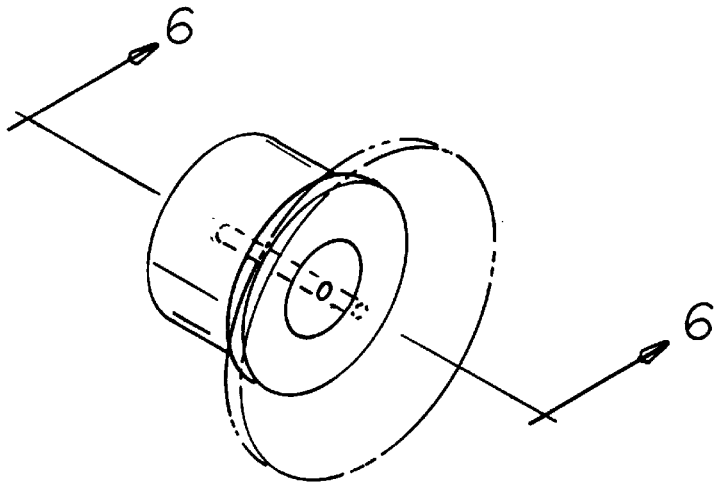
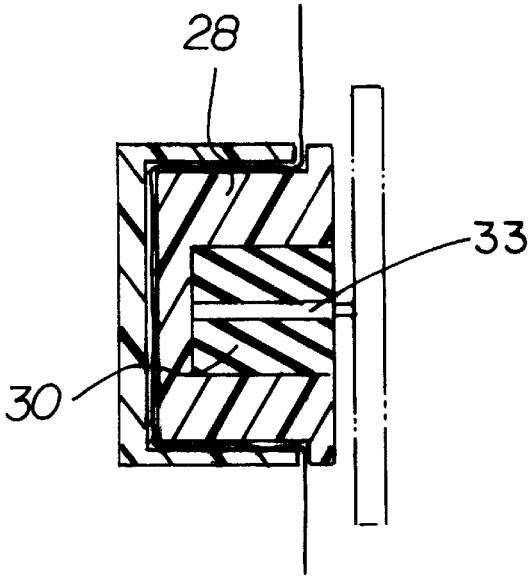
FIG 6

SNAP-IN ADAPTER SYSTEM FOR JEWELRY, NAME TAGS AND THE LIKE

BACKGROUND OF THE INVENTION

1. Field of the Invention

The present invention relates to a snap-in adapter system for jewelry, name tags and the like and more particularly pertains to securing things to clothing without piercing the clothing.

2. Description of the Prior Art

The use of attachment devices of known designs and configurations is known in the prior art. More specifically, attachment devices of known designs and configurations heretofore devised and utilized for the purpose of attaching things to clothing through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,439,439 to Stimson discloses a Decorative Button Assembly. U.S. Pat. No. 3,715,781 to Salvatori discloses a Button Assembly. U.S. Pat. No. 4,959,890 to Pazurek discloses an Interchangeable Snap Button System. U.S. Pat. No. 4,472,696 to Jenkins discloses a Ring With Replaceable Stones. U.S. Pat. No. 4,274,180 to Anderson discloses a Jewelry Clutch. Lastly, U.S. Pat. No. 5,542,157 to Herman discloses Decorative Multi-part Button Assemblies and Use Thereof.

In this respect, the snap-in adapter system for jewelry, name tags and the like according to the present invention substantially departs from the conventional concepts and designs of the prior art, and in doing so provides an apparatus primarily developed for the purpose of securing things to clothing without piercing the clothing.

Therefore, it can be appreciated that there exists a continuing need for a new and improved snap-in adapter system for jewelry, name tags and the like which can be used for securing things to clothing without piercing the clothing. In this regard, the present invention substantially fulfills this need.

SUMMARY OF THE INVENTION

In view of the foregoing disadvantages inherent in the known types of attachment devices of known designs and configurations now present in the prior art, the present invention provides an improved snap-in adapter system for jewelry, name tags and the like. As such, the general purpose of the present invention, which will be described subsequently in greater detail, is to provide a new and improved snap-in adapter system for jewelry, name tags and the like and method which has all the advantages of the prior art and none of the disadvantages.

To attain this, the present invention essentially comprises a new and improved snap-in adapter system for jewelry, name tags and the like for securing things to clothing without piercing the clothing comprises, in combination an interior piece fabricated of an elastomeric material which has a circular interior face and a short cylindrical side wall forming a cylindrical recess. The recess has an interior diameter. Also provided is an exterior piece which is fabricated of an elastomeric material, the exterior piece having a circular exterior face with a diameter essentially equal to that of the diameter of the recess of the interior piece. The exterior piece also has a cylindrical projection slightly less in diameter than the diameter of the recess. The exterior piece also has a height slightly less than the depth of the recess for being positioned within the recess of the interior piece with a wearer's fabric therebetween. A hollow tube is secured to the outer surface of the exterior piece. The tube has a small interior diameter to receive a pin, the tube having a length essentially equal to the diameter of the exterior face of the exterior piece.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved snap-in adapter system for jewelry, name tags and the like which has all of the advantages of the prior art attachment devices of known designs and configurations and none of the disadvantages.

It is another object of the present invention to provide a new and improved snap-in adapter system for jewelry, name tags and the like which may be easily and efficiently manufactured and marketed.

It is further object of the present invention to provide a new and improved snap-in adapter system for jewelry, name tags and the like which is of durable and reliable constructions.

An even further object of the present invention is to provide a new and improved snap-in adapter system for jewelry, name tags and the like which is susceptible of a low cost of manufacture with regard to both materials and labor, and which accordingly is then susceptible of low prices of sale to the consuming public, thereby making such a snap-in adapter system for jewelry, name tags and the like economically available to the buying public.

Even still another object of the present invention is to provide a snap-in adapter system for jewelry, name tags and the like for securing things to clothing without piercing the clothing.

Lastly, it is an object of the present invention to provide a new and improved snap-in adapter system including an interior piece having a circular interior face and a short cylindrical side wall forming a cylindrical recess, the recess having an interior diameter. The system also includes an exterior piece. The exterior piece has a circular exterior face with a diameter essentially equal to that of the diameter of the recess of the interior piece. The exterior piece also has a cylindrical projection. Also provided is an attachment means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of an alternate embodiment of the invention.

FIG. 6 is a cross-sectional view taken along line 6—6 of FIG. 5.

The same reference numerals refer to the same parts through the various Figures.

DESCRIPTION OF THE PREFERRED EMBODIMENT

Figure 1:
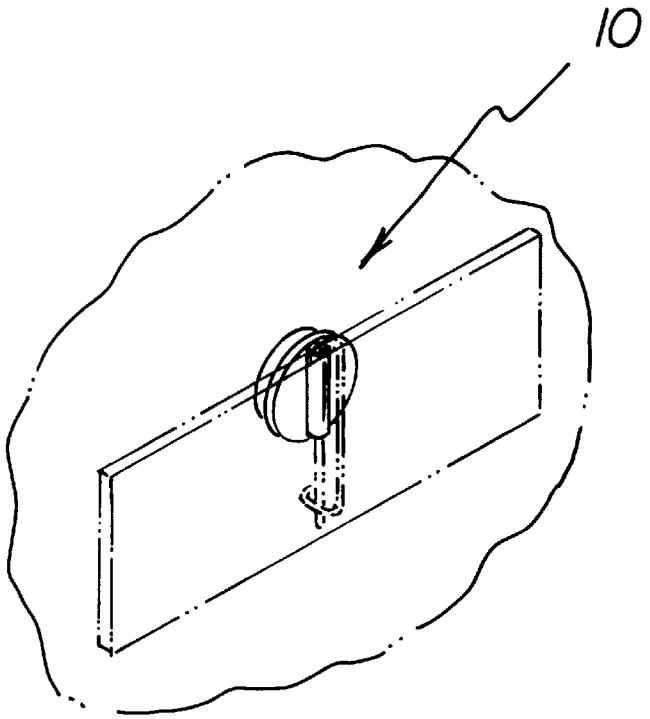
FIG. 1 is a perspective view of the preferred embodiment of the snap-in adapter system for jewelry, name tags and the like constructed in accordance with the principles of the present invention.
Figure 2:
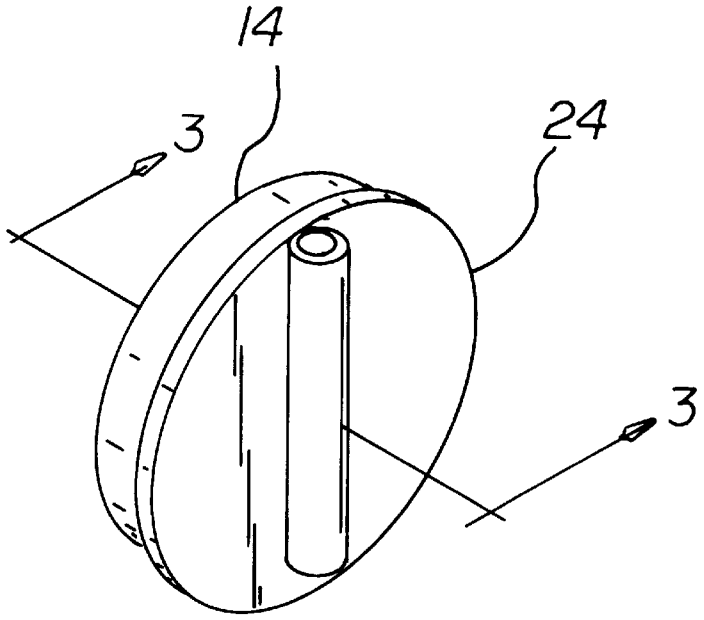
FIG. 2 is a perspective showing of the adapter system of FIG. 1.
Figure 3:
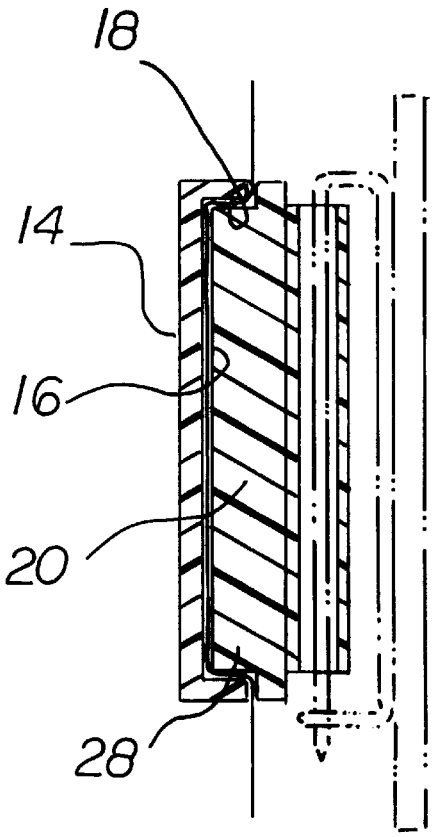
FIG. 3 is a cross-sectional view taken along line 3—3 of FIG. 2.
Figure 4:
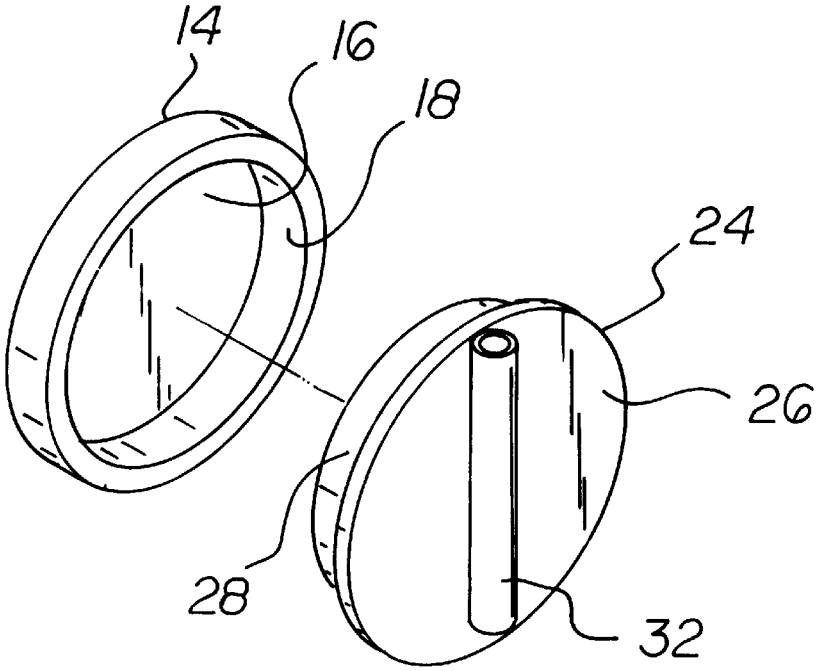
FIG. 4 is an exploded perspective view similar to FIG. 2.

With reference now to the drawings, and in particular to FIG. 1 thereof, the preferred embodiment of the new and improved snap-in adapter system for jewelry, name tags and the like embodying the principles and concepts of the present invention and generally designated by the reference numeral 10 will be described.

The present invention, the a snap-in adapter system for jewelry, name tags and the like 10 is comprised of a plurality of components. Such components are individually configured and correlated with respect to each other so as to attain the desired objective.

More specifically, the new and improved snap-in adapter system for jewelry, name tags and the like for securing things to clothing without piercing the clothing comprises, in combination an interior piece 14 fabricated of an elastomeric material which has a circular interior face 16 and a short cylindrical side wall 18 forming a cylindrical recess 20. The recess has an interior diameter.

Also provided is an exterior piece 24 which is fabricated of an elastomeric material. The exterior piece has a circular exterior face 26 with a diameter essentially equal to that of the diameter of the recess of the interior piece. The exterior piece also has a cylindrical projection 28 slightly less in diameter than the diameter of the recess. The exterior piece also has a height slightly less than the depth of the recess for being positioned within the recess of the interior piece with a wearer's fabric therebetween.

A hollow tube 32 is secured to the outer surface of the exterior piece. The tube has a small interior diameter to receive a pin, the tube having a length essentially equal to the diameter of the exterior face of the exterior piece.

FIGS. 5 and 6 illustrate an alternate embodiment of the invention. In such embodiment, the interior and exterior pieces are of a slightly greater depth when coupled together. The projection 28 of the exterior piece is formed with an outwardly facing cylindrical recess. Into such recess is placed a plug 30 preferably fabricated of an elastomeric material. In this manner, a linear pin 33 of a piece of jewelry may be placed into a central aperture of the plug as may be required for holding the jewelry in place. In addition, as mentioned above, the interior piece is of a greater depth so as to allow the pin to be placed internally a sufficient distance for the holding purposes.

As described hereinabove, the present invention is comprised of two components; namely, an outer adapter and an inner clamp. The outer adapter or backing is produced in a circular, oval, or square shape and contains a small within its center through which the inner claim extends. The pin holder or inner clamp is produced in the same shape as the outer adapter, however, it is slightly smaller. Secured to the back of the clamp is a section of sponge, rubber or expanded form and a tube into which various accessories are inserted. This product is easily producible in a variety of sizes.

To use the present invention, the user would simply insert the tip of the pin from various accessories within the tube found upon the inner clamp. Next, the accessory would be positioned in the desired location upon the wearer's clothing. It is secured in place by inserting a section of the fabric to rest between the adapter and inner clamp. The components are snapped together to secure this accessory as well as the jewelry or name tag in place. Since the device rests atop the tip of the pin it provides a protective barrier which ensures the fabric is not pierced. It is possible to produce this product in various colors as well as a transparent model. Furthermore, various sizes of this product can be produced to accommodate its use with a wide array of accessories.

The appealing features of the present device are its ability to increase the life of various clothing items thereby saving the consumer money in replacement costs. The product is convenient, practical, easy to use, and reasonably priced. The use of the present device allows individuals to wear various accessories with a larger selection of clothing, even those items produced of delicate fabrics. Thus, users could wear jewelry and other accessories more frequently for an enhanced appearance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A badge adapter system for securing jewelry, name tags and the like to clothing without piercing the clothing comprising, in combination:

an interior piece fabricated of an elastomeric material having a circular interior face and a short cylindrical side wall forming a cylindrical recess, the recess having an interior diameter;

an exterior piece fabricated of an elastomeric material, the exterior piece having a circular exterior face with a diameter essentially equal to that of the diameter of the recess of the interior piece, the exterior piece also having a cylindrical projection slightly less in diameter than the diameter of the recess, the exterior piece also having a height slightly less than the depth of the recess for being positioned within the recess of the interior piece with a wearer's clothing therebetween; and a hollow tube secured to the outer surface of the exterior piece, the tube having a small interior diameter to receive a pin, the tube having a length essentially equal to the diameter of the exterior face of the exterior piece.

2. A mounting system for mounting an article to an article of clothing without piercing the material of the clothing, the system comprising:

an interior piece having a recess formed therein;

an exterior piece having a projection adapted for removable insertion in the recess of the interior piece in a manner such that the projection of the exterior piece can be lodged in the recess of the interior piece with a portion of an article of clothing situated between the interior and exterior pieces; and a mount positioned on the exterior piece and being adapted for securing the article thereon.

3. The system as set forth in claim 2 wherein the mount includes a mounting bore positioned on the exterior piece for receiving a pin of a badge.

4. The system as set forth in claim 3 wherein the mounting bore is positioned about an axis which is normal to an outer surface of the exterior piece, wherein the mounting bore frictionally engages a pin of the article.

5. The system as set forth in claim 3 wherein the bore is positioned about an axis which is parallel with an outer surface of the exterior piece for receiving a pin of the article.

6. The system as set forth in claim 5 wherein the bore is defined by a tube mounted on the exterior piece.

7. The system as set forth in claim 2 wherein the pieces are circular.

8. The system of claim 2, wherein said mount comprises a hollow tube diametrically secured to the exterior face of the exterior piece, the tube having an interior diameter to receive a pin.

9. The system of claim 8, wherein the tube has a length essentially equal to the diameter of the exterior face of the exterior piece.

10. The system as set forth in claim 2 wherein the pieces are fabricated of an elastomeric material.

11. The system as set forth in claim 2 wherein the cylindrical projection of the exterior piece has a diameter slightly less than that of the diameter of the recess.

12. The system set forth in claim 2 wherein the cylindrical projection of the exterior piece has a diameter slightly less than that of the exterior face of the exterior piece.

13. A mounting system for mounting an article to an article of clothing without piercing the material of the clothing, the system comprising:

an interior piece comprised of an elastomeric material having a circular interior face and an elongated cylindrical side wall forming a cylindrical recess, the recess having an interior diameter;

an exterior piece comprised of an elastomeric material, the exterior piece having a circular exterior face with a diameter essentially equal to that of the diameter of the recess of the interior piece, the exterior piece also having a cylindrical projection slightly less in diameter than the diameter of the recess such that interposing a portion of an article of clothing between the projection and the recess causes stretching of the cylindrical side wall of the interior piece when the projection is inserted into the cylindrical recess;

a recess formed in the exterior face of the exterior piece; and a plug mounted within the recess with a bore formed therein which remains normal to the exterior face of the exterior piece.

14. The system set forth in claim 13, wherein a depth of the exterior piece is greater than that of the bore.

* * * * *